US010876527B2

(12) United States Patent
Quintarelli et al.

(10) Patent No.: US 10,876,527 B2
(45) Date of Patent: Dec. 29, 2020

(54) BLEED VALVE AND SELF-BLEEDING PUMP PROVIDED WITH SUCH VALVE

(71) Applicant: SEKO S.p.A., Rieti (IT)

(72) Inventors: Mauro Quintarelli, Rieti (IT); Luigino Esposito, Rieti (IT)

(73) Assignee: SEKO S.P.A., Rieti (IT)

( * ) Notice: Subject to any disclaimer, the term of this patent is extended or adjusted under 35 U.S.C. 154(b) by 486 days.

(21) Appl. No.: 15/735,995

(22) PCT Filed: Jun. 21, 2016

(86) PCT No.: PCT/IB2016/053681
§ 371 (c)(1),
(2) Date: Dec. 13, 2017

(87) PCT Pub. No.: WO2016/207788
PCT Pub. Date: Dec. 29, 2016

(65) Prior Publication Data

US 2018/0180040 A1 Jun. 28, 2018

(30) Foreign Application Priority Data

Jun. 22, 2015 (IT) ..... 102015000026295

(51) Int. Cl.
*F04B 53/06* (2006.01)
*F04B 13/00* (2006.01)
(Continued)

(52) U.S. Cl.
CPC ..... *F04B 53/06* (2013.01); *F04B 13/00* (2013.01); *F04B 43/02* (2013.01); *F04B 53/1002* (2013.01)

(58) Field of Classification Search
CPC ..... F16K 24/046; F16K 24/042; F16K 15/04; F16K 15/042; F04B 53/06
(Continued)

(56) References Cited

U.S. PATENT DOCUMENTS 3,416,461 A * 12/1968 McFarland ..... F04B 43/067 417/568
3,661,167 A * 5/1972 Hussey ..... F04B 43/02 137/269.5
(Continued)

FOREIGN PATENT DOCUMENTS

DE 28 03 470 8/1979
DE 2803470 A1 * 8/1979 ..... F04B 53/06
(Continued)

OTHER PUBLICATIONS

Operating Instructions Manual Solenoid Dosing Pump Beta® BT4a and BT5a, by ProMinent (Year: 2020).*
(Continued)

*Primary Examiner* — Charles G Freay
*Assistant Examiner* — Thomas Fink
(74) *Attorney, Agent, or Firm* — Nixon & Vanderhye P.C.

(57) ABSTRACT

Bleed valve having a longitudinal axis, the bleed valve having an operative configuration wherein the longitudinal axis extends in a vertical direction, the bleed valve comprising a one-way valve, an intermediate duct, a support and a cap which are in a vertical alignment from bottom to top of the bleed valve when the bleed valve is in its operative configuration, wherein the one-way valve is adapted to put, when it assumes an open configuration, a lower through hole in communication with the intermediate duct, wherein the support is coupled to the cap so as to form a cavity in which a ball is housed, the cap being provided with a main aperture communicating with outside of the bleed valve, said cavity being adapted to let the ball move between a lower limit position, that the ball assumes when subject only to gravity and the bleed valve is in its operative configuration and wherein the support supports the ball, and an upper limit position in which the ball occludes the main aperture, the bleed valve being characterised in that the support is pro-
(Continued)

vided with a passage communicating with the intermediate duct, the cap being further provided with a secondary aperture communicating with outside of the bleed valve, the ball occluding the passage of the support when it is in the lower limit position, wherein the cap has a shape and size adapted to form a gap between the cap and the ball when the ball is in the upper limit position wherein the gap is adapted to put the secondary aperture in communication with said cavity, whereby the secondary aperture is always in communication with said cavity for any position assumed by the ball within said cavity.m Self-bleeding pump provided with such bleed valve.

16 Claims, 5 Drawing Sheets

(51) Int. Cl.
*F04B 43/02* (2006.01)
*F04B 53/10* (2006.01)

(58) Field of Classification Search
USPC ..... 137/216.2, 217, 202
See application file for complete search history.

(56) References Cited

U.S. PATENT DOCUMENTS 4,865,525 A * 9/1989 Kern ..... F04B 23/06 417/307
4,898,077 A 2/1990 McBeth
5,435,335 A * 7/1995 Klop ..... B67D 7/365 137/202
5,957,669 A * 9/1999 Parikh ..... F04B 9/02 417/362
6,168,390 B1 * 1/2001 Hunklinger ..... F04B 53/06 417/299
6,354,819 B1 * 3/2002 Parikh ..... F04B 9/02 137/454.4
2006/0283505 A1 * 12/2006 Makowan ..... F16K 24/046 137/388
2009/0000667 A1 * 1/2009 Bottura ..... F16K 15/042 137/202
2012/0312399 A1 * 12/2012 Gerz ..... F04B 53/06 137/565.01
2014/0056724 A1 * 2/2014 Kotlyar ..... F04B 43/02 417/53

FOREIGN PATENT DOCUMENTS

DE 40 25 114 2/1992
EP 2 728 189 5/2014
WO WO 2013/156087 10/2013

OTHER PUBLICATIONS

International Search Report dated Oct. 10, 2016 issued in PCT International Patent Application No. PCT/IB2016/053681, 2 pp.

* cited by examiner

BLEED VALVE AND SELF-BLEEDING PUMP PROVIDED WITH SUCH VALVE

This application is the U.S. national phase of International Application No. PCT/IB2016/053681 filed Jun. 21, 2016 which designated the U.S. and claims priority to Italian Patent Application No. 102015000026295 filed Jun. 22, 2015, the entire contents of each of which are hereby incorporated by reference.

The present invention concerns a bleed valve, and the self-bleeding pump provided with such bleed valve, in particular a diaphragm dosing pump, that allows in a simple, reliable, efficient, and inexpensive way to remove gas present in the pumping chamber of the pump, increasing the efficiency of the pump, making the same adapted to dosing even corrosive chemicals and/or gas products, and reducing the need for manual interventions.

In the following of this description, reference will be mainly made to diaphragm dosing pumps. However, it must be noted that the bleed valve according to the invention may be also applied to a pump configured to carry out a volume pumping of a fluid in a variable-volume pumping chamber different from a diaphragm pump, e.g. a plunger piston pump, that may be used in any hydraulic circuit for applications even different from dosing and mixing, still remaining within the scope of protection of the present invention.

It is known that dosing apparatuses are widespread. In particular, in the industrial and professional sectors, such apparatuses allow addition of concentrated chemicals, such as for instance oxidants, acidifiers, alkalizers, lubricants, disinfectants, and soaps.

Such apparatuses comprise dosing pumps, configured to carry out a volume pumping of a fluid in a variable-volume pumping chamber, which contribute to adding various substances to water or other process solutions.

In particular, the diaphragm dosing pumps comprise a diaphragm coupled to a plate integrally coupled to a piston configured to perform an reciprocating motion, whereby the diaphragm also performs a reciprocating motion that modifies the volume of the pumping chamber. The latter is provided with a one-way suction valve and with a one-way delivery valve, each one of which is usually implemented by means of a double ball valve.

When the pump operate in steady-state, i.e. after the initial priming phase, the volume pumping occurs through alternation of a suction phase, wherein a liquid is sucked from a suction line (usually comprising a tank) and fills the pumping chamber, and of a delivery phase, wherein the liquid in the pumping chamber is pushed in the external delivery line. In particular, at the beginning of the suction phase (coinciding with the phase of return of the piston), the volume of the pumping chamber is minimum (and equal to the dead volume of the latter) and pressures present on the suction and delivery valves cause the suction valve to open and the delivery valve to close, whereby the liquid is sucked, through the suction valve, in the pumping chamber until the volume thereof is maximum; differently, at the beginning of the delivery phase (coinciding with the pushing phase of the piston), the volume of the pumping chamber is maximum and pressures present on the suction and delivery valves cause the suction valve to close and the delivery valve to open, whereby the liquid is pushed, through the delivery valve, from the pumping chamber to the delivery line until the volume of the pumping chamber is minimum.

Most diaphragm dosing pumps also have a channel, normally interrupted by a bleed manual valve, connected between the pair of balls of the delivery valve or to the pumping chamber (i.e. placed between the pair of suction and delivery valves), which channel permits bleeding of gas possibly present in the pumping chamber. The gas may be air present in the dead volume in the pumping chamber (equal to the minimum volume of the pumping chamber) during priming, or air sucked from the suction line of the pump or gas that is released from unstable fluids (liquids) or having high content of dissolved gases, that in conditions of low pressure in the suction line tend to be released.

When the delivery line of the pump is connected to a line at a pressure higher than the atmospheric one, if the dead volume of the pumping chamber is not entirely occupied by the fluid (liquid) to pump, the gas inside the pumping chamber requires less work for compressing than for exceeding the force for opening the delivery valve, causing non-operation of the pump. In this case, opening the bleed manual valve permits to discharge the gas at atmospheric pressure until the dead volume of the pumping chamber is fully filled with the fluid (liquid) to pump. Once the whole volume of the pumping chamber has been filled, the bleed manual valve is closed.

Such operation of opening and closing the bleed manual valve is typical during the first priming of the pump, which operation is normally carried out under presence of an operator. However, the operator intervention is further necessary in case of fluids (liquids) containing dissolved gases, or in case of depriming due to even temporary lack of fluid (liquid) to pump.

This is a serious problem because, since it requires the intervention of an operator, it inhibits an automatic operation of the pump.

Some prior art solutions to such problem have proposed self-bleeding pumps.

A first prior art self-bleeding pump is shown in FIG. 1*a*, where the pump body 700 comprises, besides the suction valve 701 and the delivery valve 703, an additional channel provided with a specific bleed valve 702 implemented through a double ball valve, that slightly opens in delivery phase and regularly closes in suction phase, and that is vertically positioned at the highest point of the pumping chamber, in order to bleed the gas that normally tends to be located at the highest positions. A second prior art self-bleeding pump is shown in FIGS. 1*b* and 1*c*, the pump body 800 of which also comprises, besides the suction valve 801 and the delivery valve 803, a bleed valve 802 similar to the one of the pump of FIG. 1*a*, still vertically arranged at the highest point of the pumping chamber.

In the two prior art self-bleeding pumps of FIG. 1, the arrangement of the bleed valve 702 or 802 in the highest part of the pump body 700 or 800 of the pump head implies the positioning of the delivery valve 703 or 803 in lateral position that is inclined (as in the pump of FIG. 1*a*) or orthogonal to the diaphragm plane (as in the pump of FIGS. 1*b* and 1*c*), imposing the use of a metallic spring 804, usually of steel, that correctly keeps the (sole) ball 805 of such delivery valve 703 or 803 in position; as known, the spring is not normally required when the delivery valve is vertically positioned because, in this case, the balls are kept in position by gravity.

A self-bleeding pump similar to the pump of FIGS. 1*b* and 1*c* is the Beta® 1601 PP SEK pump available from the German company ProMinent Dosiertechnik GmbH.

The use of metallic springs create further drawbacks, such as the impossibility to use the pump for dosing corrosive chemicals.

Another drawback of the prior art self-bleeding pumps is the poor dosing efficiency, since the bleed valve 702 or 802 normally bleeds a significant amount of fluid, during the delivery phase, towards the suction line instead of towards the delivery line. Moreover, it is not possible to provide for a manual closing of the bleed channel, that instead would permit a pump operation at the maximum efficiency when no degassing of the liquid da pump is needed.

In the prior art, other self-bleeding pumps have been also proposed, such as those disclosed for instance by U.S. Pat. No. 4,898,077A and WO2013156087A1, which however suffer from the drawback of being particularly complex, and consequently expensive, not completely efficient, not always adapted to be used with corrosive chemicals, and further requiring a frequent maintenance. A further example of self-bleeding pump is disclosed in EP2728189A1.

Therefore, it is an object of the present invention to allow in a simple, reliable, efficient, and inexpensive way to remove gas present in the pumping chamber of the pump, increasing the efficiency of the pump, making the same adapted to dosing even corrosive chemicals, and reducing the need for manual interventions.

It is specific subject matter of the present invention a bleed valve having a longitudinal axis, the bleed valve having an operative configuration wherein the longitudinal axis extends in a vertical direction, the bleed valve comprising a one-way valve, an intermediate duct, a support and a cap which are in a vertical alignment from bottom to top of the bleed valve when the bleed valve is in its operative configuration, wherein the one-way valve is adapted to put, when it assumes an open configuration, a lower through hole in communication with the intermediate duct, wherein the support is coupled to the cap so as to form a cavity in which a ball is housed, the cap being provided with a main aperture communicating with outside of the bleed valve, said cavity being adapted to let the ball move between a lower limit position, that the ball assumes when subject only to gravity and the bleed valve is in its operative configuration and wherein the support supports the ball, and an upper limit position in which the ball occludes the main aperture, the bleed valve being characterised in that the support is provided with a passage communicating with the intermediate duct, the cap being further provided with a secondary aperture communicating with outside of the bleed valve, the ball occluding the passage of the support when it is in the lower limit position, wherein the cap has a shape and size adapted to form a gap between the cap and the ball when the ball is in the upper limit position wherein the gap is adapted to put the secondary aperture in communication with said cavity, whereby the secondary aperture is always in communication with said cavity for any position assumed by the ball within said cavity. In particular, the vertical direction in which the longitudinal axis of the bleed valve extends when the latter is in its operative configuration may be a substantially vertical direction, wherein the cap is at a height substantially higher than the height at which the support is, the support is at a height substantially higher than the height at which the intermediate duct is, and the intermediate duct is at a height substantially higher than the height at which the one-way valve is.

In other words, the bleed valve according to the invention, having a longitudinal axis configured to assume a vertical direction, comprises a lower one-way valve configured to put, when it assumes an open configuration, a lower through hole in communication with an intermediate duct, the bleed valve further comprising a support coupled to a cap so as to form an upper cavity wherein an upper ball is housed, the support being configured to support the upper ball and being provided with a passage communicating with the intermediate duct, the cap being provided with a main aperture and with a secondary aperture, said upper cavity being configured to house the upper ball so that the latter may move between a lower limit position, that it assumes at rest and in which it occludes the passage of the support, and an upper limit position, in which it occludes the main aperture, wherein the cap is configured such that when the upper ball assumes the upper limit position a gap exists between the cap and the upper ball that puts the secondary aperture in communication with said upper cavity, whereby the cap is configured such that, for any position assumed by the upper ball within said upper cavity, the secondary aperture is always in communication with said upper cavity.

According to another aspect of the invention, the main aperture may be arranged in axial position and the secondary aperture may be arranged in lateral position.

According to a further aspect of the invention, the main aperture and/or the secondary aperture may be cylindrical.

According to an additional aspect of the invention, the cross section of the secondary aperture may have area lower than that of the cross section of the main aperture.

According to another aspect of the invention, the intermediate duct and/or the passage may be arranged in axial position.

According to a further aspect of the invention, the intermediate duct and/or the passage may be cylindrical.

According to an additional aspect of the invention, the cross section of the passage may have area lower than that of the cross section of the intermediate duct.

According to another aspect of the invention, the one-way valve may be a ball valve.

It is specific subject matter of the present invention a self-bleeding pump configured to carry out a volume pumping of a fluid in a variable-volume pumping chamber when the self-bleeding pump is in an operative configuration, comprising a suction inlet, that houses a suction valve arranged in vertical orientation when the self-bleeding pump is in its operative configuration and connected to the pumping chamber through a suction duct, and a delivery outlet, that houses a delivery valve arranged in vertical orientation when the self-bleeding pump is in its operative configuration and connected to the pumping chamber through a delivery duct, the self-bleeding pump being characterised in that it further comprises a bleed outlet, that houses a bleed valve as previously described, wherein the bleed valve is in its operative configuration when the self-bleeding pump is in its operative configuration and wherein the bleed valve is connected to the pumping chamber through a bleed duct.

According to a further aspect of the invention, a manual valve for enabling bleeding may be inserted in the bleed duct, whereby, when the manual valve assumes an open configuration, the bleed valve is connected to the pumping chamber, and when the manual valve assumes a closed configuration the bleed valve is disconnected from the pumping chamber.

According to another aspect of the invention, the bleed valve may be connected to a highest point of the pumping chamber when the self-bleeding pump is in its operative configuration.

According to an additional aspect of the invention, the suction valve may be connected to a lowest point or at an intermediate point of the pumping chamber when the self-bleeding pump is in its operative configuration.

According to another aspect of the invention, the delivery valve may be connected to a highest point or at an intermediate point of the pumping chamber when the self-bleeding pump is in its operative configuration.

According to a further aspect of the invention, the self-bleeding pump may be a diaphragm pump or a plunger piston pump.

In other words, the bleed valve according to the invention allows to make a self-bleeding pump wherein both the delivery valve and the bleed valve are arranged in vertical direction, and wherein at least the bleed valve is connected to the highest point of the pumping chamber. Optionally, the pump may be provided with a manual valve that allows to enable or disable operation of the bleed valve.

The advantages offered by the bleed valve and by the related self-bleeding pump according to the invention are evident.

First of all, the self-bleeding pump according to the invention does not necessarily requires any metallic spring (e.g. of steel) that is not compatible with corrosive chemicals. However, it must be noted that the arrangement of the self-bleeding pump according to the invention could be also provided with springs for those applications allowing them, i.e. when there are no chemically aggressive fluids.

Moreover, the bleed valve according to the invention is implemented so as to minimise the bleeding of fluid towards the bleed duct (and the suction line) during the delivery phase down to substantially neglectable amounts, whereby pump efficiency is not affected by operation of the bleed valve.

The present invention will be now described, by way of illustration and not by way of limitation, according to its preferred embodiments, by particularly referring to the Figures of the annexed drawings, in which.

Figure 1:
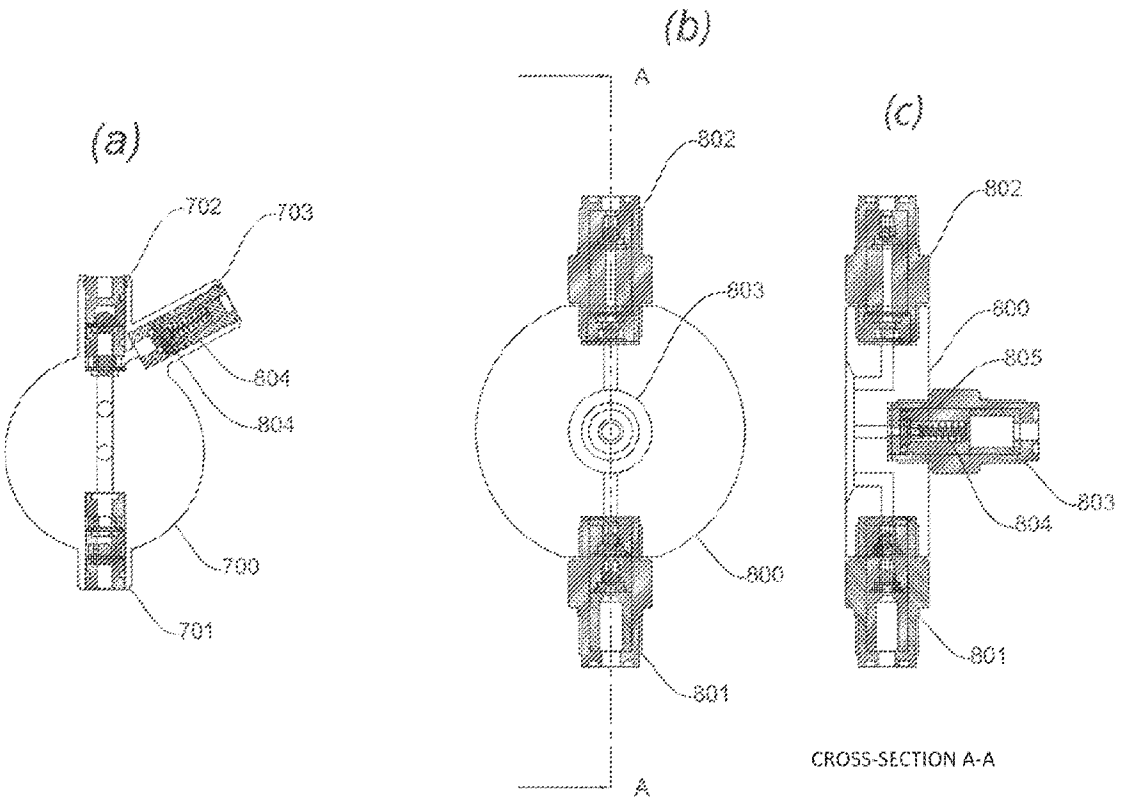
Fig. 1 (Prior Art)
FIG. 1 shows a schematic front cross-section view of a first prior art self-bleeding pump (FIG. 1*a*), and a schematic front view (FIG. 1*b*) and a cross-section view along the plane A-A of FIG. 1*b* (FIG. 1*c*) of a second prior art self-bleeding pump.
Figure 2:
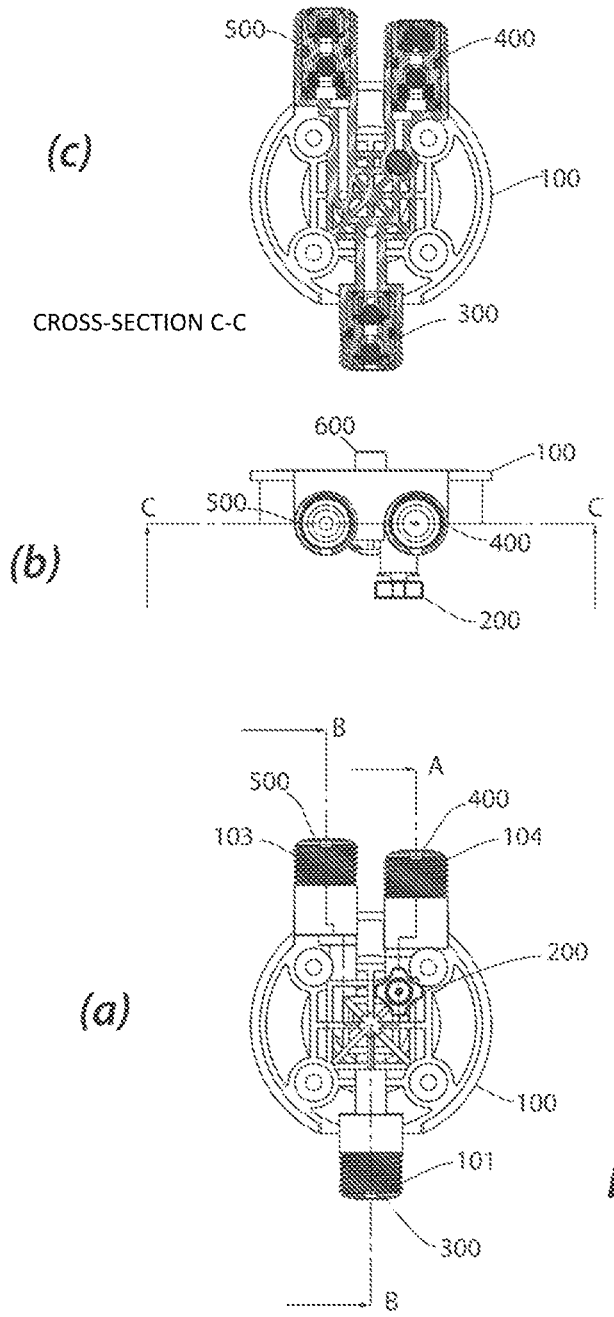
FIG. 2 shows a front view (FIG. 2*a*), a top plan view of a portion (FIG. 2*b*) and a cross-section view along the plane C-C of FIG. 2*b* (FIG. 2*c*) of a first embodiment of the self-bleeding pump according to the invention.
Figure 3:
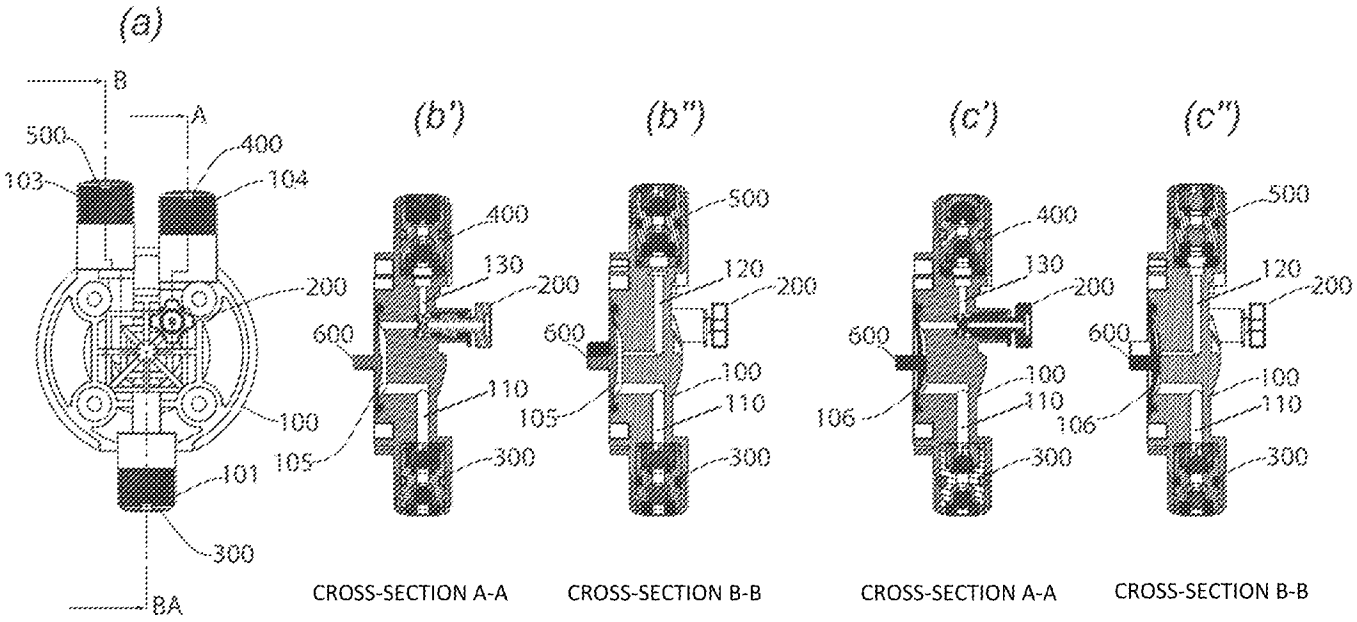
Figure 4:
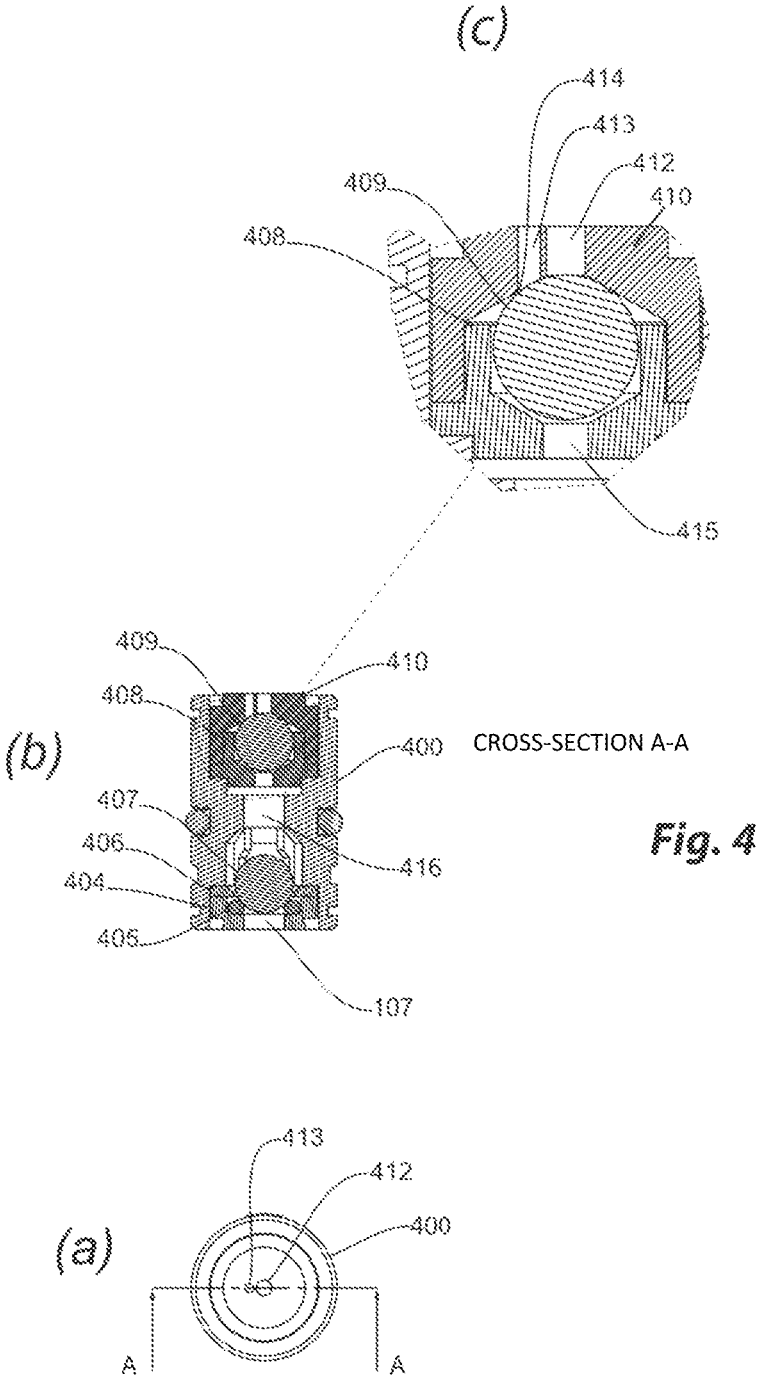
Figure 5:
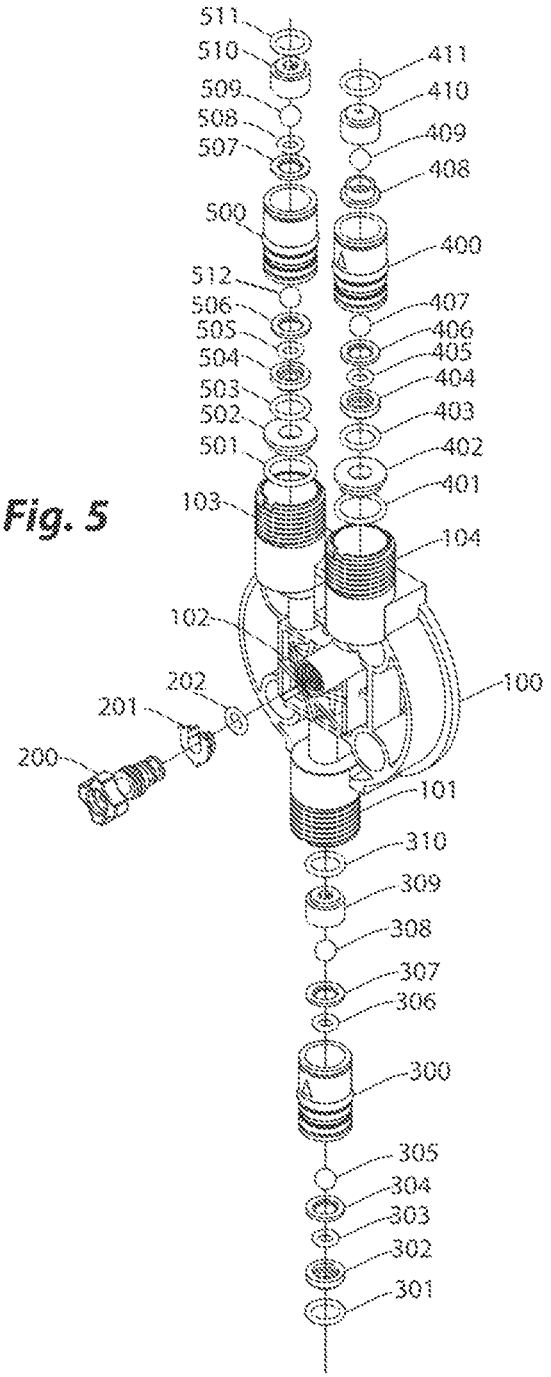

FIG. 3 shows a front view (FIG. 3*a*), a cross-section view along the plane A-A of FIG. 3*a* during suction phase (FIG. 3*b*'), a cross-section view along the plane B-B of FIG. 3*a* during suction phase (FIG. 3*b*"), a cross-section view along the plane A-A of FIG. 3*a* during delivery phase (FIG. 3*c*'), and a cross-section view along the plane B-B of FIG. 3*a* during delivery phase (FIG. 3*c*") of the self-bleeding pump of FIG. 2;

FIG. 4 shows a top plan view (FIG. 4*a*), a cross-section view along the plane A-A of FIG. 4*a* (FIG. 4*b*), and an enlargement of a particular of the view of FIG. 4*b* (FIG. 4*c*) of a first embodiment of the bleed valve according to the invention; and FIG. 5 shows an exploded perspective view of the self-bleeding pump of FIG. 2.

In the Figures identical reference numerals will be used for alike elements.

Making reference to FIGS. 2 and 3, it may be observed that a preferred embodiment of the self-bleeding pump according to the invention is a diaphragm pump comprising a pump body 100 housing a pumping chamber, the volume of which varies in function of the position of the diaphragm 600 performing the reciprocating motion when operated by an electromagnet or other mechanism. The preferred embodiment of the self-bleeding pump further comprises a suction inlet 101, that houses a suction valve 300 arranged in vertical direction and connected to the lowest point of the pumping chamber through a suction duct 110, and a delivery outlet 103, that houses a delivery valve 500 arranged in vertical direction and connected to an intermediate point (above the lowest point) of the pumping chamber through a delivery duct 120.

Also, the preferred embodiment of the self-bleeding pump comprises a bleed outlet 104, that houses the preferred embodiment of the bleed valve according to the invention (indicated with the reference numeral 400) that is arranged in vertical direction and connected to the highest point of the pumping chamber through a bleed duct 130 in which a manual valve 200 for enabling bleeding is inserted.

Conventionally, the suction inlet 101, the delivery outlet 103 and the bleed outlet 104 have each a respective threaded end portion, for allowing attachment of external ducts.

In particular, FIG. 3 shows the circuit of the fluid during suction and delivery phases, as illustrated in the following.

FIG. 3*b*' shows the section of the circuit of the fluid between the suction inlet 101 and the bleed outlet 104, intercepted by the manual valve 200, during suction phase when the pumping chamber has maximum volume 105. FIG. 3*b*" shows the section of the circuit of the fluid between the suction inlet 101 and the delivery outlet 103 still during suction phase when the pumping chamber has maximum volume 105. In both FIGS. 3*b*' and 3*b*", diaphragm 600 is in its rest position.

FIG. 3*c*' shows the section of the circuit of the fluid between the suction inlet 101 and the bleed outlet 104, intercepted by the manual valve 200, during delivery phase when the pumping chamber has minimum volume 106. FIG. 3*c*" shows the section of the circuit of the fluid between the suction inlet 101 and the delivery outlet 103 still during delivery phase when the pumping chamber has minimum volume 106. In both FIGS. 3*c*' and 3*c*", diaphragm 600 is in its position of maximum stroke.

The difference between maximum volume 105 and minimum volume 106 is equal to the amount of fluid (liquid) pumped per movement cycle of diaphragm 600.

When the pumping chamber is not entirely filled only with liquid, but there is entirely or partially gas, suction capability of the pump is limited by the dead volume equivalent to the minimum volume 106. In this regard, the higher the ratio of minimum volume 106 to maximum volume 105, the lower the suction height of the pump is in above head configuration (i.e. for a suction height $h_{asp}$ that is positive, where the suction height $h_{asp}$ is equal to the difference between the height of the suction inlet 101 and the height of the level of the liquid to pump in the respective tank).

In absence of the bleed valve 400 according to the invention housed in the bleed outlet 104, as long as the pumping chamber (even when it has maximum volume 106 during delivery phase) is not entirely filled only with liquid, the possibility of transferring liquid to the delivery line through the delivery valve 500 housed in the delivery outlet 103 would be inhibited when pressure of the delivery line is higher than the atmospheric one, since the work necessary for opening the delivery valve 500, when the latter is charged by high upstream pressures, would be larger than the work necessary for compressing the gas present in the pumping chamber.

The bleed valve 400 according to the invention housed in the bleed outlet 104 allows to solve such problem. Making particular reference to FIG. 4, it may be observed that the preferred embodiment of the bleed valve according to the invention comprises a container (indicated with the reference numeral 400 that indicates in FIGS. 2-3 the same bleed valve as a whole) having a longitudinal axis (that assumes a vertical direction when the valve is housed in the bleed outlet 104), within which a lower annular seat 404 is housed for receiving an O-ring 405, maintained in position by a locking ring 406 that abuts against the lower inner profile of the container 400. A lower ball 407 is housed inside a lower axial cavity and that, at rest, leans on the O-ring 405 by gravity ensuring sealing, and implementing a lower ball valve. The lower axial cavity is configured to communicate, when the lower ball 407 is lifted from its rest position, with the through hole 107 of the lower annular seat 404; the latter in turn communicates with the bleed duct 130.

The lower axial cavity housing the lower ball 407 communicates with an (optionally cylindrical) axial intermediate duct 416, on top of which a support 408 of an upper ball 409 abuts; the support 408 is provided with an (optionally cylindrical) axial passage 415 communicating with the axial intermediate duct 416, and the cross section of which advantageously has area lower than that of the cross section of the axial intermediate duct 416. A cap 410 abuts on the support 408, so that support 408 and cap 410 form an upper axial cavity in which the upper ball 409 is housed; the cap 410 is provided with an (optionally cylindrical) axial main aperture 412 and with an (optionally cylindrical) lateral secondary aperture 413, the cross section of which advantageously has area lower than that of the cross section of the axial main aperture 412. In particular, the axial main aperture 412 and the lateral secondary aperture 413 communicates with the outside of the bleed valve independently from one another, i.e. the axial main aperture 412 and the lateral secondary aperture 413 are two distinct apertures towards the outside of the bleed valve.

The upper axial cavity is configured to house the upper ball 409 so that the latter may move between a lower limit position, that it assumes by gravity and in which it occludes the axial passage 415 of the support 408 (thus implementing an upper dedicated valve) and lets both the axial main aperture 412 and the lateral secondary aperture 413 in communication with the upper axial cavity housing the upper ball 409, and an upper limit position, in which it occludes the axial main aperture 412 and lets both the axial main aperture 412 and the lateral secondary aperture 413 in communication with the upper axial cavity housing the upper ball 409.

The cap 410 is configured so that, for any position assumed by the upper ball 409 within the upper axial cavity, the lateral secondary aperture 413 is always in communication with the upper axial cavity housing the upper ball 409; in particular, even when the upper ball 409 assumes the upper limit position in which it occludes the axial main aperture 412, a gap 414 always exists between the cap 410 and the upper ball 409 that puts the lateral secondary aperture 413 in communication with the upper axial cavity. In other words, the cap 410 has a shape and size adapted to form a gap 414 between the cap 410 and the upper ball 409 when the upper ball 409 is in its upper limit position, wherein the gap 414 is adapted to put the lateral secondary aperture 413 in communication with the upper axial cavity.

It should be noted that other embodiments of the bleed valve according to the invention may comprise an axial main aperture and/or a lateral secondary aperture of the cap 410 having any shape, even different from a cylindrical shape. Moreover, the main aperture may be also arranged in a position different from the axial one and/or the secondary aperture may be also arranged in a position different from the lateral one. Similarly, the arrangement of the through holes and/or of the cavities and/or of the ducts must not be necessarily axial, but it can be any other.

Also, further embodiments of the bleed valve according to the invention may comprise a number and/or a shape and/or size of the component elements different with respect to what illustrated for the preferred embodiment with reference to FIGS. 2-5.

Furthermore, other embodiments of the bleed valve according to the invention may comprise lower one-way valves different from the lower ball valve (implemented through the component elements 404, 405, 406 and 407).

Moreover, further embodiments of the self-bleeding pump according to the invention may be devoid of the manual valve 200 for enabling bleeding, whereby the bleed function of the same pump is always enabled.

Also, other embodiments of the self-bleeding pump according to the invention may also have the delivery valve that is connected to the highest point of the pumping chamber, and in this case the delivery duct 120 and the bleed duct 130 could share an initial portion.

Moreover, further embodiments of the self-bleeding pump according to the invention may have the bleed valve that is not exactly connected to the highest point of the pumping chamber, but it may be connected to an intermediate point, advantageously arranged on the upper part of the pumping chamber.

Also, other embodiments of the self-bleeding pump according to the invention may have the suction valve that is not connected to the lowest point of the pumping chamber, for instance the suction valve 300 may be connected to an intermediate point of the pumping chamber.

When the manual valve 200 for enabling bleeding is set so that the bleed duct 130 is not closed by the same manual valve 200, in the case where in the delivery phase the pumping chamber at least partially contains gas, the latter (especially when it is unable to open the delivery valve 500) reaches the through hole 107 of the lower annular seat 404, then it lifts the lower ball 407 (i.e. it opens the lower ball valve, that hence assumes an open configuration, when the pressure in the through hole 107 is higher than the pressure in the axial intermediate duct 416), and, through the axial intermediate duct 416, it reaches and passes (since it is gas) the axial passage 415 of the support 408, and it exits from the axial main aperture 412 and lateral secondary aperture 413 of the cap 410.

Still with the bleed duct 130 not closed by the manual valve 200 for enabling bleeding, in the case where in the delivery phase the pumping chamber entirely contains liquid, the latter reaches the through hole 107 of the lower annular seat 404, then it lifts the lower ball 407 (i.e. it opens the lower ball valve). Through the axial intermediate duct 416, it reaches the axial passage 415 of the support 408, it moves in a pulsed way the upper ball 409 by pushing the same to occlude the axial main aperture 412 of the cap 410, therefore significantly limiting the bleeding of the fluid from the bleed valve 400. As stated, the lateral secondary aperture 413 of the cap 410 is never completely occluded, and the gap 414 puts the lateral secondary aperture 413 in communication with the axial intermediate duct 416, avoiding pressurisation of the same axial intermediate duct 416 that would not permit any more the lift of the opening of the lower ball 407 (i.e. the opening of the lower ball valve) by gas to bleed that is possibly present again in the pumping chamber (e.g., in the case where the liquid to pump contains dissolved gases or in case of pump depriming).

FIG. 5 shows an exploded perspective view of the preferred embodiment of the self-bleeding pump according to the invention, immediately comprehensible to those skilled in the art.

In particular, a sealing O-ring 401 maintained in position by a supporting annular base 402 of the container 400 of the bleed valve is located inside the bleed outlet 400, where the annular base 402 abuts on the inner profile of the bleed duct 130; a further sealing O-ring 403 is interposed between the annular base 402 and the lower annular seat 404 of the bleed valve.

The suction valve comprises a container (indicated with the reference numeral 300 that indicates in FIGS. 2-3 the same suction valve as a whole) having a longitudinal axis (that assumes a vertical direction when the valve is housed in the suction inlet 101), inside which a lower ball valve and an upper ball valve are housed. The lower ball valve of the suction valve comprises a first sealing O-ring 301 housed below an annular seat 302 receiving a second O-ring 303, maintained in position by a locking ring 304 that abuts against the lower inner profile of the container 300; a lower ball 305 is housed inside a lower axial cavity of the container 300 and, at rest, it leans on the second O-ring 303 by gravity and/or by pressurisation of the suction duct 110 ensuring the sealing. The upper ball valve of the suction valve comprises a first sealing O-ring 310 housed above a cylindrical hollow seat 309, having an axial cavity in which an upper ball 308 is housed, which upper ball is configured to lean, at rest, on a locking ring 307 that abuts against the upper inner profile of the container 300 and that maintains a second O-ring 306 in position; the upper ball 308, at rest, leans on the second O-ring 306 by gravity and/or by pressurisation of the suction duct 110 ensuring the sealing.

The delivery valve comprises a container (indicated with the reference numeral 500 that indicates in FIGS. 2-3 the same delivery valve as a whole) having a longitudinal axis (that assumes a vertical direction when the valve is housed in the delivery outlet 103); in particular, a sealing O-ring 501 maintained in position by a supporting annular base 502 of the container 500 of the delivery valve is located inside the delivery outlet 500, where the annular base 502 abuts on the inner profile of the delivery duct 120. A lower ball valve and an upper ball valve are housed within the container 500. The lower ball valve of the delivery valve comprises a first sealing O-ring 503 that is interposed between the supporting annular base 502 of the container 500 and an annular seat 504 receiving a second O-ring 505, maintained in position by a locking ring 506 that abuts against the lower inner profile of the container 500; a lower ball 512 is housed inside a lower axial cavity of the container 500 and, at rest, it leans on the second O-ring 505 by gravity and/or by pressurisation of the delivery line ensuring the sealing. The upper ball valve of the delivery valve comprises a first sealing O-ring 511 housed above a cylindrical hollow seat 510, having an axial cavity in which an upper ball 509 is housed, which upper ball is configured to lean, at rest, on a locking ring 507 that abuts against the upper inner profile of the container 500 and that maintains a second O-ring 508 in position; the upper ball 509, at rest, leans on the second O-ring 508 by gravity and/or by pressurisation of the delivery line ensuring the sealing.

The manual valve 200 for enabling bleeding, that is configured to close or open the bleed duct 130, is provided with an advance limiter 201 and with a sealing O-ring 202.

The preferred embodiments of this invention have been described and a number of variations have been suggested hereinbefore, but it should be understood that those skilled in the art can make other variations and changes without so departing from the scope of protection thereof, as defined by the attached claims.

The invention claimed is:

1. Bleed valve comprising a single container and having a longitudinal axis, the bleed valve having an operative configuration wherein the longitudinal axis extends in a vertical direction, the bleed valve comprising a one-way valve, an intermediate duct, a support and a cap housed inside the single container and which are in a vertical alignment from bottom to top of the bleed valve when the bleed valve is in its operative configuration, wherein the one-way valve is adapted to put, when it assumes an open configuration, a lower through hole in communication with the intermediate duct, wherein the support is coupled and abutted to the cap so as to form a cavity in which a ball is housed, the cap being provided with a main aperture communicating with outside of the bleed valve, said cavity being adapted to let the ball move between a lower limit position; that the ball assumes when subject only to gravity and the bleed valve is in its operative configuration and wherein the support supports the ball, and an upper limit position in which the ball occludes the main aperture, wherein the support is provided with a passage communicating with the intermediate duct, the cap being further provided with a secondary aperture communicating with outside of the bleed valve, the ball occluding the passage of the support when it is in the lower limit position, wherein the cap has a shape and size adapted to form a gap between the cap and the ball when the ball is in the upper limit position wherein the gap is adapted to put the secondary aperture in communication with said cavity, whereby the secondary aperture is always in communication with said cavity for any position assumed by the ball within said cavity.

2. Bleed valve according to claim 1, wherein the main aperture is arranged in axial alignment with the longitudinal axis and the secondary aperture is arranged in a position lateral from the longitudinal axis.

3. Bleed valve according to claim 1, wherein the main aperture and/or the secondary aperture are cylindrical.

4. Bleed valve according to claim 1, wherein the cross section of the secondary aperture has area lower than that of the cross section of the main aperture.

5. Bleed valve according to claim 1, wherein the intermediate duct and/or the passage are arranged in axial alignment with the longitudinal axis.

6. Bleed valve according to claim 1, wherein the intermediate duct and/or the passage are cylindrical.

7. Bleed valve according to claim 1, wherein the cross section of the passage has area lower than that of the cross section of the intermediate duct.

8. Bleed valve according to claim 1, wherein the one-way valve is a ball valve.

9. Self-bleeding pump configured to carry out a volume pumping of a fluid in a variable-volume pumping chamber when the self-bleeding pump is in an operative configuration, comprising a suction inlet, that houses a suction valve arranged in vertical orientation when the self-bleeding pump is in its operative configuration and connected to the pumping chamber through a suction duct, and a delivery outlet, that houses a delivery valve arranged in vertical orientation when the self-bleeding pump is in its operative configuration and connected to the pumping chamber through a delivery duct, wherein the self-bleeding pump further comprises a bleed outlet that houses a bleed valve comprising a single container and having a longitudinal axis, the bleed valve having an operative configuration wherein the longitudinal axis extends in a vertical direction, the bleed valve comprising a one-way valve, an intermediate duct, a support and a cap housed inside the single container and which are in a vertical alignment from bottom to top of the bleed valve when the bleed valve is in its operative configuration, wherein the one-way valve is adapted to put, when it assumes an open configuration, a lower through hole in communication with the intermediate duct, wherein the support is coupled and abutted to the cap so as to form a cavity in which a ball is housed, the cap being provided with a main aperture communicating with outside of the bleed valve, said cavity being adapted to let the ball move between a lower limit position; that the ball assumes when subject only to gravity and the bleed valve is in its operative configuration and wherein the support supports the ball, and an upper limit position in which the ball occludes the main aperture, wherein the support is provided with a passage communicating with the intermediate duct, the cap being further provided with a secondary aperture communicating with outside of the bleed valve, the ball occluding the passage of the support when it is in the lower limit position, wherein the cap has a shape and size adapted to form a gap between the cap and the ball when the ball is in the upper limit position wherein the gap is adapted to put the secondary aperture in communication with said cavity, whereby the secondary aperture is always in communication with said cavity for any position assumed by the ball within said cavity, wherein the bleed valve is in its operative configuration when the self-bleeding pump is in its operative configuration and wherein the bleed valve is connected to the pumping chamber through a bleed duct.

10. Self-bleeding pump according to claim 9, wherein the bleed valve is connected to a highest point of the pumping chamber when the self-bleeding pump is in its operative configuration.

11. Self-bleeding pump according to claim 9, wherein the suction valve is connected to a lowest point or at an intermediate point of the pumping chamber when the self-bleeding pump is in its operative configuration.

12. Self-bleeding pump according to claim 9, wherein the delivery valve is connected to a highest point or at an intermediate point of the pumping chamber when the self-bleeding pump is in its operative configuration.

13. Self-bleeding pump according to claim 9, wherein the self-bleeding pump is a diaphragm pump or a plunger piston pump.

14. A bleed valve positioned in a bleed outlet, the bleed valve comprising:

a container having a longitudinal axis;

a lower valve disposed in the container and communicating with a bleed duct and an axial intermediate duct;

a ball valve support disposed in the container and associated with the axial intermediate duct, the ball valve support having an axial passage communicating with the axial intermediate duct; and a cap disposed in the container and abutting the ball valve support, wherein the cap and the ball valve support define an upper axial cavity of a ball valve including a ball disposed in the upper axial cavity, the cap including an axial main aperture and a lateral secondary aperture, both of which separately communicate with outside of the bleed valve, wherein the cap is configured such that for any position assumed by the ball in the upper axial cavity, the lateral secondary aperture is always in communication with the upper axial cavity.

15. A bleed valve according to claim 14, wherein a cross-section of the axial passage has a smaller area than a cross-section of the axial intermediate duct.

16. A bleed valve according to claim 14, wherein the cap is sized and shaped to form a gap between the cap and the ball when the ball is in an upper limit position, and wherein the gap is positioned to put the lateral secondary aperture in communication with the upper axial cavity.

* * * * *